US007228666B2

(12) United States Patent
Michiels

(10) Patent No.: US 7,228,666 B2
(45) Date of Patent: Jun. 12, 2007

(54) DEVICE FOR EQUIPPING AN EXPANSION JOINT, IN PARTICULAR AN EXPANSION JOINT BETWEEN CONCRETE SLABS

(75) Inventor: Pierre Michiels, Tervuren (BE)

(73) Assignee: Plakabeton S.A., Ternat (BE)

( * ) Notice: Subject to any disclaimer, the term of this patent is extended or adjusted under 35 U.S.C. 154(b) by 0 days.

(21) Appl. No.: 10/645,274

(22) Filed: Aug. 21, 2003

(65) Prior Publication Data

US 2004/0107661 A1 Jun. 10, 2004

(30) Foreign Application Priority Data

Aug. 21, 2002 (EP) ..... 02447159

(51) Int. Cl.
*E04F 15/14* (2006.01)
*E04B 1/68* (2006.01)
*E01C 11/04* (2006.01)

(52) U.S. Cl. ..... 52/396.05; 52/396.02; 404/55; 404/58

(58) Field of Classification Search ..... 52/367, 52/364, 250, 255, 395, 403, 403.1, 393, 396.02, 52/396.04, 396.05, 396.07, 573.1; 404/50, 404/51, 57, 58, 55
See application file for complete search history.

(56) References Cited

U.S. PATENT DOCUMENTS 1,880,725 A * 10/1932 Bleck ..... 404/48
2,130,859 A * 9/1938 Robertson ..... 404/58
2,138,817 A * 12/1938 Jacobson ..... 404/55
2,278,023 A * 3/1942 Robertson ..... 404/51
2,349,983 A * 5/1944 Musall ..... 404/56
4,063,839 A * 12/1977 Brown ..... 404/69
4,111,584 A * 9/1978 Fyfe ..... 404/69
4,332,504 A * 6/1982 Arai ..... 404/68
5,363,619 A * 11/1994 McPhee ..... 52/367
6,598,364 B1 * 7/2003 Pelles ..... 52/396.02

FOREIGN PATENT DOCUMENTS

WO WO 0134912 5/2001

* cited by examiner

*Primary Examiner*—Tamara L. Graysay
(74) *Attorney, Agent, or Firm*—Ladas & Parry LLP

(57) ABSTRACT

A device for making a connection between concrete slabs, the device having two modules derived from sheets, each module having a number of flat elements which form projections, each module further having elements in the form of a right angle, having a flat part integral with projection, and a raised part, and longitudinal members between the raised parts, and wherein the modules are assembled in such a way that the raised parts and longitudinal members of the two modules are facing each other along the two sides of a center plane, and that the projections extend on both sides of the center plane, so as to form meshing projections which pass from one side of the joint to the other.

7 Claims, 7 Drawing Sheets

30

3
1
6
9

13
4
8

1
2

30

3
1
9

4
7

1
2

30

31
32
9

1
4
7

1
2

30

1
9a
7
8
4
9b
7
8
9a

4

1
2

DEVICE FOR EQUIPPING AN EXPANSION JOINT, IN PARTICULAR AN EXPANSION JOINT BETWEEN CONCRETE SLABS

BACKGROUND OF THE INVENTION

The present invention relates to the construction sector, in particular that of slabs for industrial floors and, more particularly, concerns a device which is used for equipping expansion joints between adjacent slabs.

In this description, the word "joint" is used exclusively to denote the zone or space between two adjacent slabs while, in the area of construction, this term is generally used to refer to the device itself which occupies such a zone.

Devices for equipping expansion joints are known in the area of concrete structures. The effect desired from this type of device is to form a connection between adjacent slabs while at the same time allowing limited movement of one slab relative to the other in the plane of the slabs, said movement being due essentially at first to the shrinkage of concrete during setting and subsequently, after setting, to thermal expansion and contraction. The devices are supposed to ensure the transfer of loads between adjacent slabs and to preserve the planarity of the slabs as a whole while avoiding fractures and damage at the edges of the slabs.

The device is to be designed to allow quick and easy placement during the casting of the concrete slabs. It should likewise ensure that the edges of the slabs have sufficient mechanical resistance to rolling stresses, i.e. stresses resulting from vehicles rolling over the slabs, and the like.

A first known solution in the prior art uses sliding dowels which cross the joint and penetrate into the concrete on both sides and which can be provided with armoring reinforcements. These are rather complex systems which are difficult to place and to keep in place during the casting of the slabs. In particular, there is a difficulty in keeping the dowels parallel to each other during installation on site.

The following documents are related to devices which use dowelling. Document WO0134912 is related to an expansion joint between concrete slabs, characterized in that at least two dowels are retained by one runner that substantially divides adjoining concrete slabs. Document U.S. Pat. No. 2,349,983 is related to a device for dowelling transverse joints of concrete road pavements. Document U.S. Pat. No. 2,138,817 is related to a road joint equipped with a pair of spaced members having alternating feet sections, and dowels penetrating the road joint.

Another device uses load transfer plates, which are placed underneath the joint in such a way as to extend from one edge of said joint to the other and which are provided with anchoring elements. One disadvantage is that it is difficult to align individual plates along a rectilinear joint. Moreover, this type of device does not provide any reinforcement of the upper part of the joint, referred to as "lips of the joint" in the technical jargon.

OBJECTS OF THE INVENTION

The present invention aims to provide a device which enables an expansion joint between two slabs to be equipped and offers a solution to existing problems with the prior-art devices.

SUMMARY OF THE INVENTION

The present invention is related to a device intended to establish a connection between two adjacent slabs, preferably concrete slabs, by equipping the expansion joint between said slabs, wherein said device is constituted by an assembly of two modules derived from sheets, each of the modules comprising:

- a first series of flat elements, which form projections,
- a second series of elements in the form of a right angle, which are integral with said projections, said elements in the form of a right angle comprising a first flat part, which is in the same plane as said projections, and a raised second flat part, which forms a right angle with said first part,
- flat elements, which are in the same plane as said raised parts and which form connections in the form of first longitudinal members between said raised parts, the assembly being formed by assembling said two modules in such a way that the raised parts of the first and second module face each other along the two sides of a center plane and the longitudinal members of the first and second module equally face each other along the two sides of said same center plane, and that the projections of each module extend on both sides of said center plane.

A device of the invention may furthermore comprise flat elements which are in the same plane as said projections and form connections in the form of second longitudinal members, each second longitudinal member being present between the ends of one of said projections and of one of said first parts, being situated in the same plane as said projections.

A device of the invention may furthermore comprise a separation element, such as a foil or sheet, between the two modules.

The modules derived from sheets may be fixed to one another by temporary fixing means. Said modules may be provided with anchoring elements.

The invention is equally related to a module intended to be used in a device of the invention, wherein said module comprises:

- a first series of flat elements, which form projections,
- a second series of elements in the form of a right angle, which are integral with said projections, said elements in the form of a right angle comprising a first flat part, which is in the same plane as said projections, and a raised second flat part, which forms a right angle with said first part,
- flat elements, which are in the same plane as said raised part and which form connections in the form of first longitudinal members between said raised parts.

A module of the invention may furthermore comprise flat elements which are in the same plane as said projections and which form connections in the form of second longitudinal members, each second longitudinal member being present between the ends of one of said projections and one of said first parts, being situated in the same plane as said projections..

DETAILED DESCRIPTION OF THE INVENTION

Figure 1:
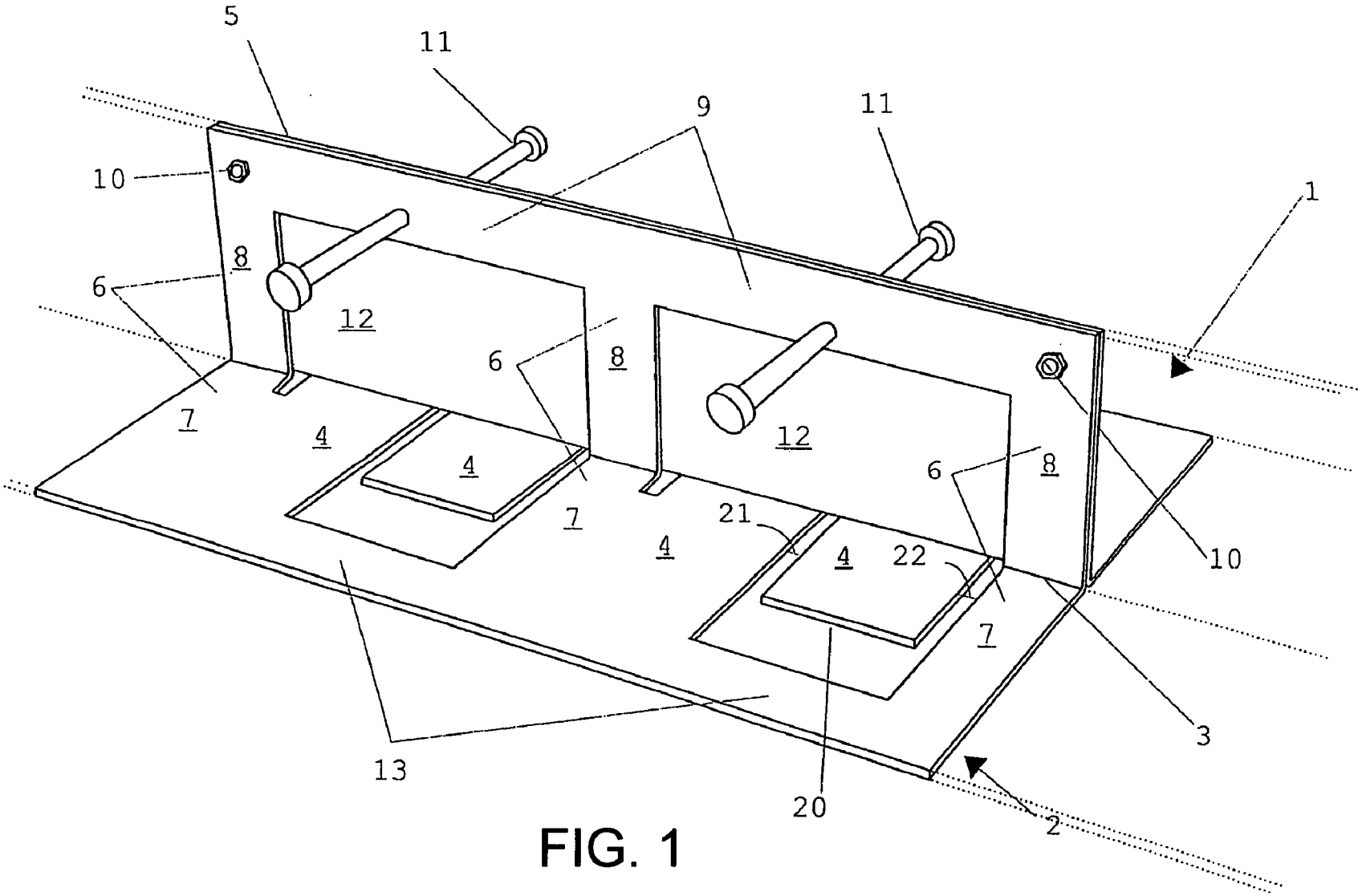
FIGS. 1 and 2 represent, by way of illustration, perspective views of two similar modules forming a device according to the present invention.

FIG. 1 shows part of a device according to the invention. As indicated by dotted lines, a complete device extends in such a way that the constituent parts repeat themselves over a longer length, more particularly the length of the complete joint which is provided. The device is constituted by two similar modules (references 1 and 2), which are constructed from two sheets of metal, preferably steel. The sheets are cut according to a predetermined pattern, then folded along a line 3 in such a way as to form meshing flat parts 4 which pass from one side of the joint to the other underneath the center plane 5. For on-site placement, the center plane 5 is provided to coincide with that of the joint between the slabs. Each module 1 or 2 derived from a cut and shaped sheet has a series of these flat plates 4, which will also be referred to as "projections" 4 of each module. Between these projections 4 of each of the two modules 1 or 2, there is a series of elements 6 in the form of a right angle, said elements 6 being integral with the projections 4 and having a part 7 in the same plane as the projections and a raised part 8. These raised parts 8 are attached to each other at their ends by a first longitudinal member 9 which is vertical when in position. The purpose of the longitudinal members 9 is to reinforce the upper part or edge of the slabs, that it is to say the part which will form the lips of the joint. In the device of the invention, the raised part 8 of one module 1 is back to back with the raised part 8 of the other module 2, and the longitudinal member 9 of one module is equally back to back with the longitudinal member 9 of the other module 2. The modules 1 and 2 are preferably secured by temporary fixing means, such as bolts 10, clips or other adequate means.

A separation sheet 12 is preferably enclosed between modules 1 and 2 so as to separate the concrete on each side of the joint. The separation sheet 12 can be made of metal or of a synthetic material, preferably a compressible synthetic material such as rigid polystyrene foam.

Anchoring elements in various forms, dowels 11 for example, are preferably attached to the longitudinal member 9 of each of the two modules 1 and 2. Such anchoring elements are not necessarily perpendicular to the part 8 and other angles may be chosen.

Figure 2:
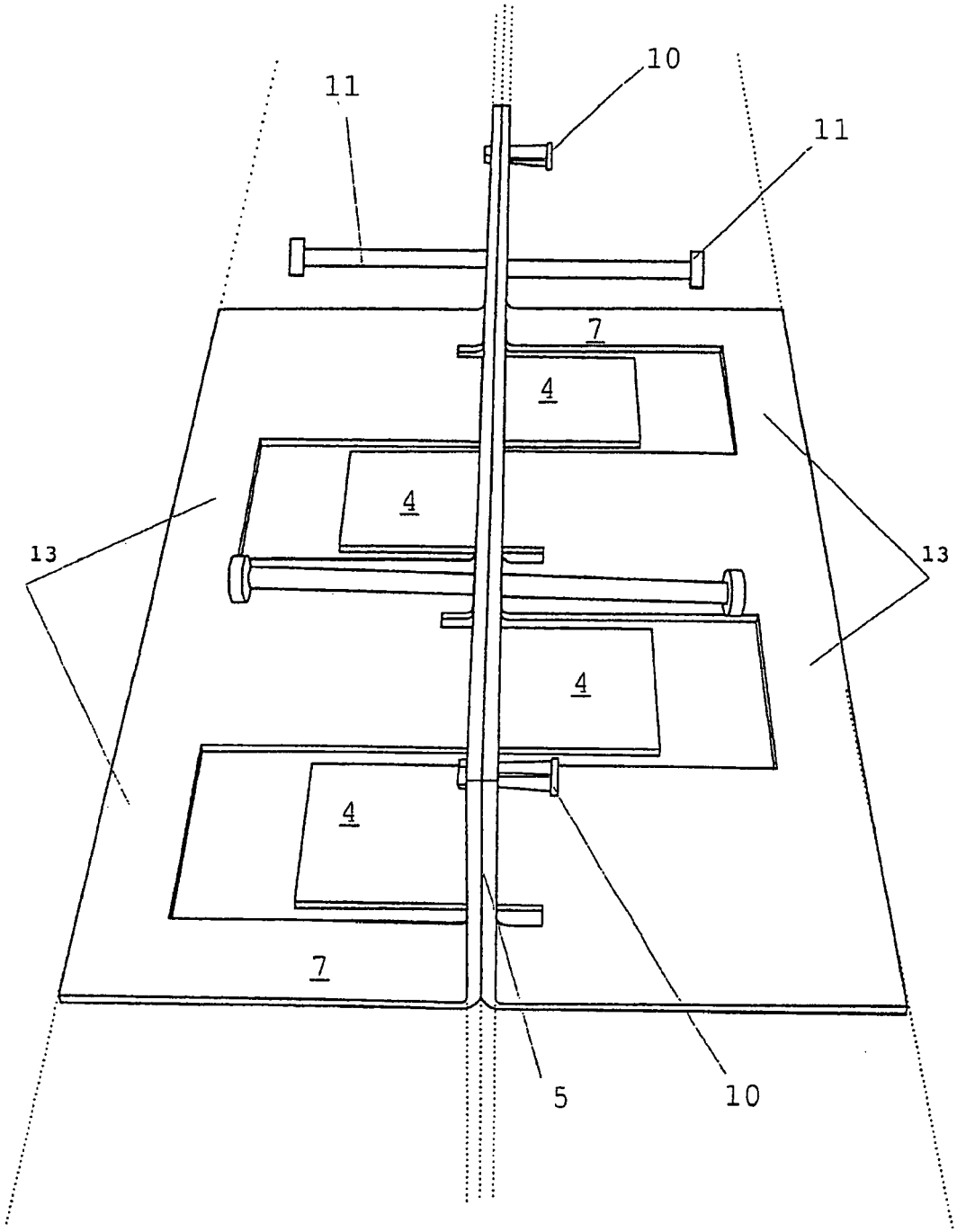

In the embodiment shown in FIGS. 1 and 2, each of the projections 4 of each module is connected to the part 7 of the adjacent projection by a flat second longitudinal member 13 which is horizontal when in position. It will be noted that this longitudinal member 13 does not constitute an essential element. It is purely optional within the context of the invention even though it contributes to the rigidity of the assembly owing to the fact that it is situated underneath the slab or is embedded in the latter.

The length of the projections 4 is preferably such that there is no direct contact between the end 20 of a projection belonging to one module 1 or 2 and the flat longitudinal member 13 of the other module. In the same way, the distance 21 between two adjacent projections of the two modules 1 and 2, as well as the distance 22 between a projection 4 of one module 1 or 2 and a flat part 7 of the other module, is such that there is no direct contact between the elements separated by said distances. In general, it may be stated that a projection 4 belonging to one module 1 or 2 is not in physical contact with any part of the other module in the assembly of the invention. In each embodiment of the invention, the projections 4 of the device form a meshing pattern, it being possible for parts 6 in the form of a right angle to be situated between two consecutive projections.

The characteristic features of the invention are as follows: it concerns a continuous device which can be installed over a significant length of the joint, thus facilitating placement and alignment. Said device is generally assembled before being put in place on site. While being continuous, said device comprises parts 4 which are underneath or embedded in concrete slabs while crossing the joint. The projections 4 are situated on each side of said joint, thus ensuring the desired transfer of loads. The device furthermore comprises parts 6 in the form of a right angle, attached to each other by longitudinal members 9 situated at the two sides of the upper parts of the joint, thus forming a reinforcement of the lips of the joint and securing the whole.

Figures 3A, 3B, 3C, 3D:
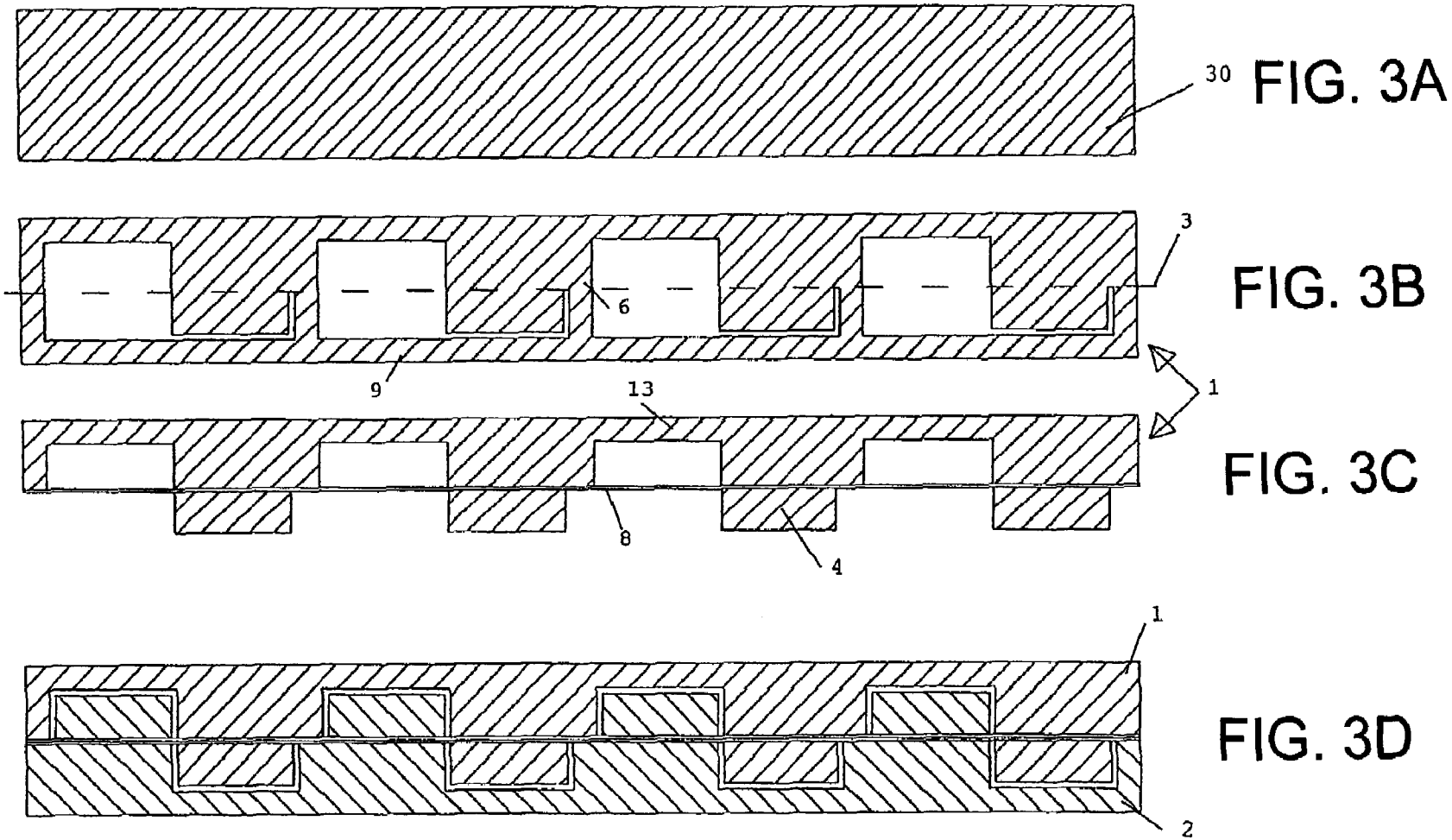
FIGS. 3*a* to 3*d* represent a first sheet cutting, folding and assembly pattern for achieving a first embodiment of the invention.

FIGS. 3*a* to 3*d* show an example of a cutting, folding and assembly pattern for a sheet 30 so as to form a module 1 that will form part of the device of the invention shown in FIGS. 1 and 2. After cutting, the sheet 30 is folded at right angles along the line 3 in such a way that the elements 4 remain in the initial plane. FIG. 3*c* shows the result, viewed from above. The projections 4, the parts 6 in the form of a right angle, the first longitudinal members 9 in the plane at right angles, and the second longitudinal members 13 in the plane of the projections can again be seen. FIG. 3*d* shows the assembly of two shaped and cut modules 1 and 2 of the same type to form a device according to the invention.

Figure 4A:
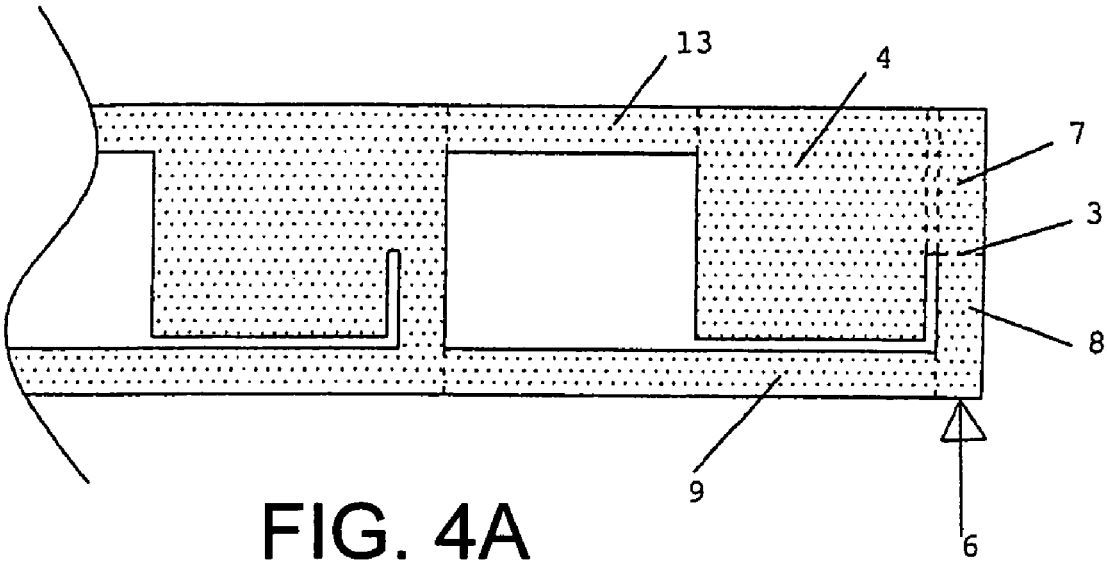
FIGS. 4*a* and 4*b* represent details of cutting patterns for achieving two different embodiments of the invention.
Figure 4B:
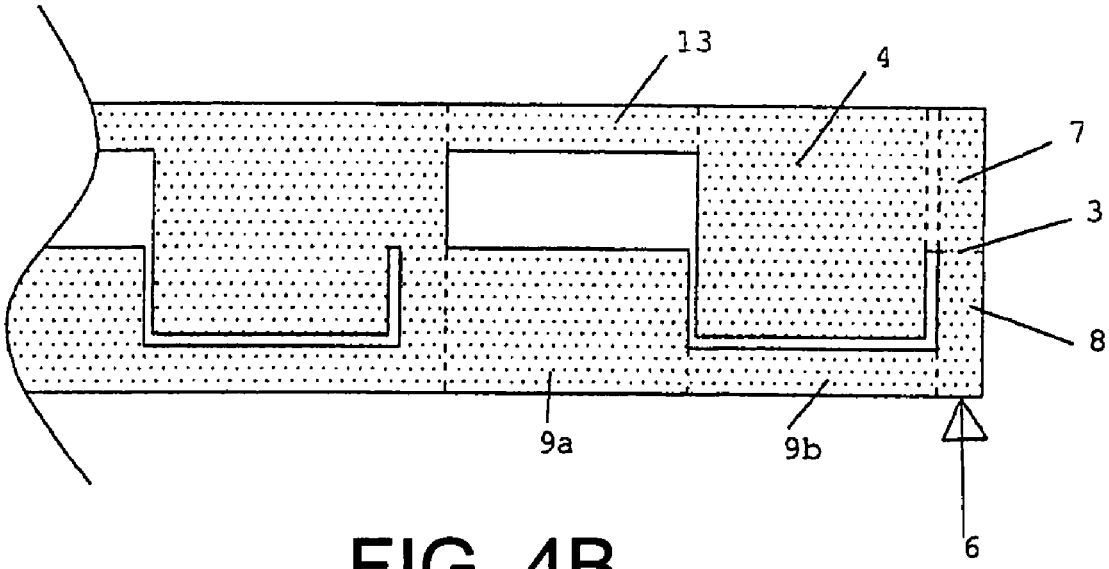
Figures 5A, 5B, 5C, 5D:
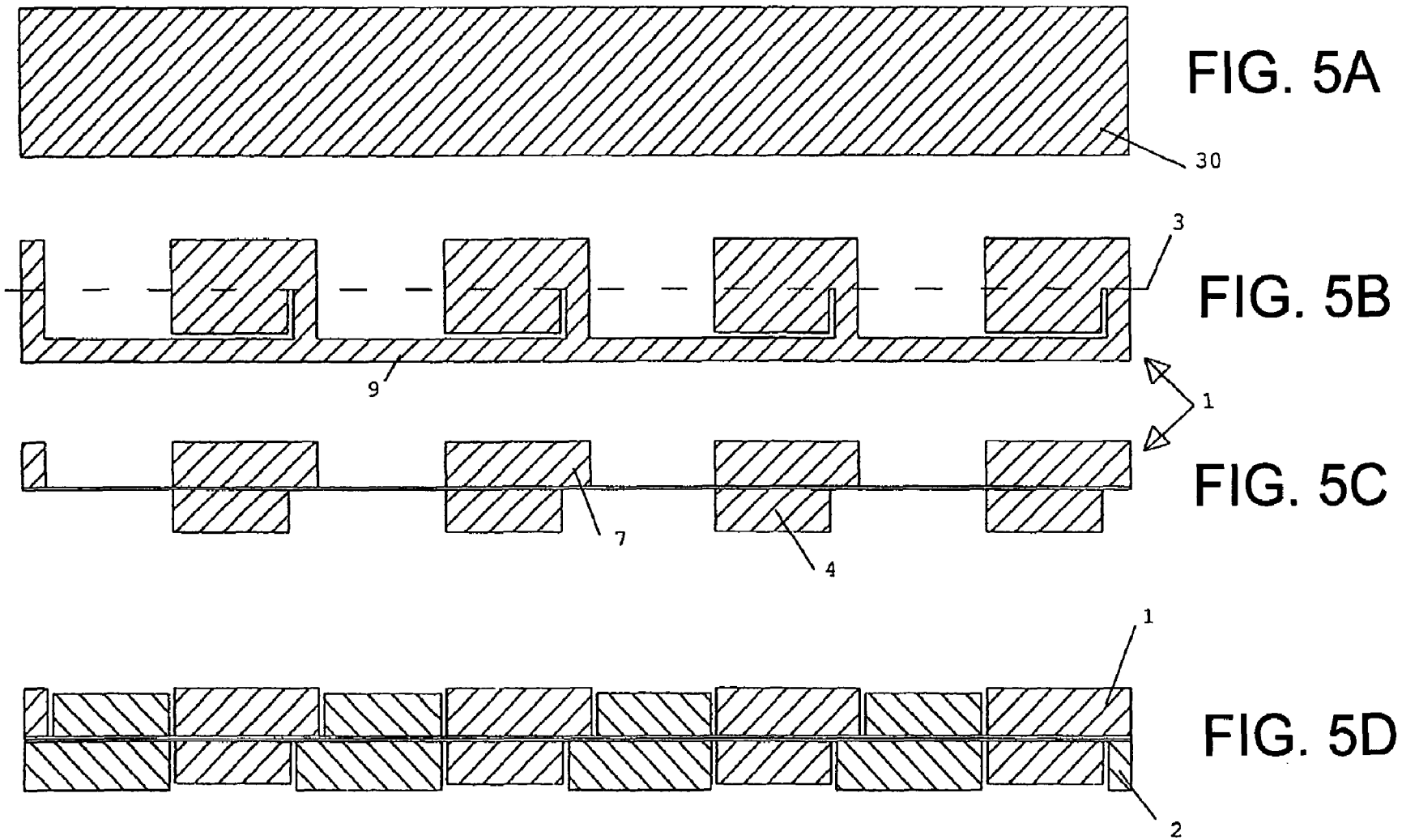
FIGS. 5*a* to 5*d* represent a second sheet cutting, folding and assembly pattern for achieving a device according to the invention.
Figures 6A, 6B, 6C, 6D:
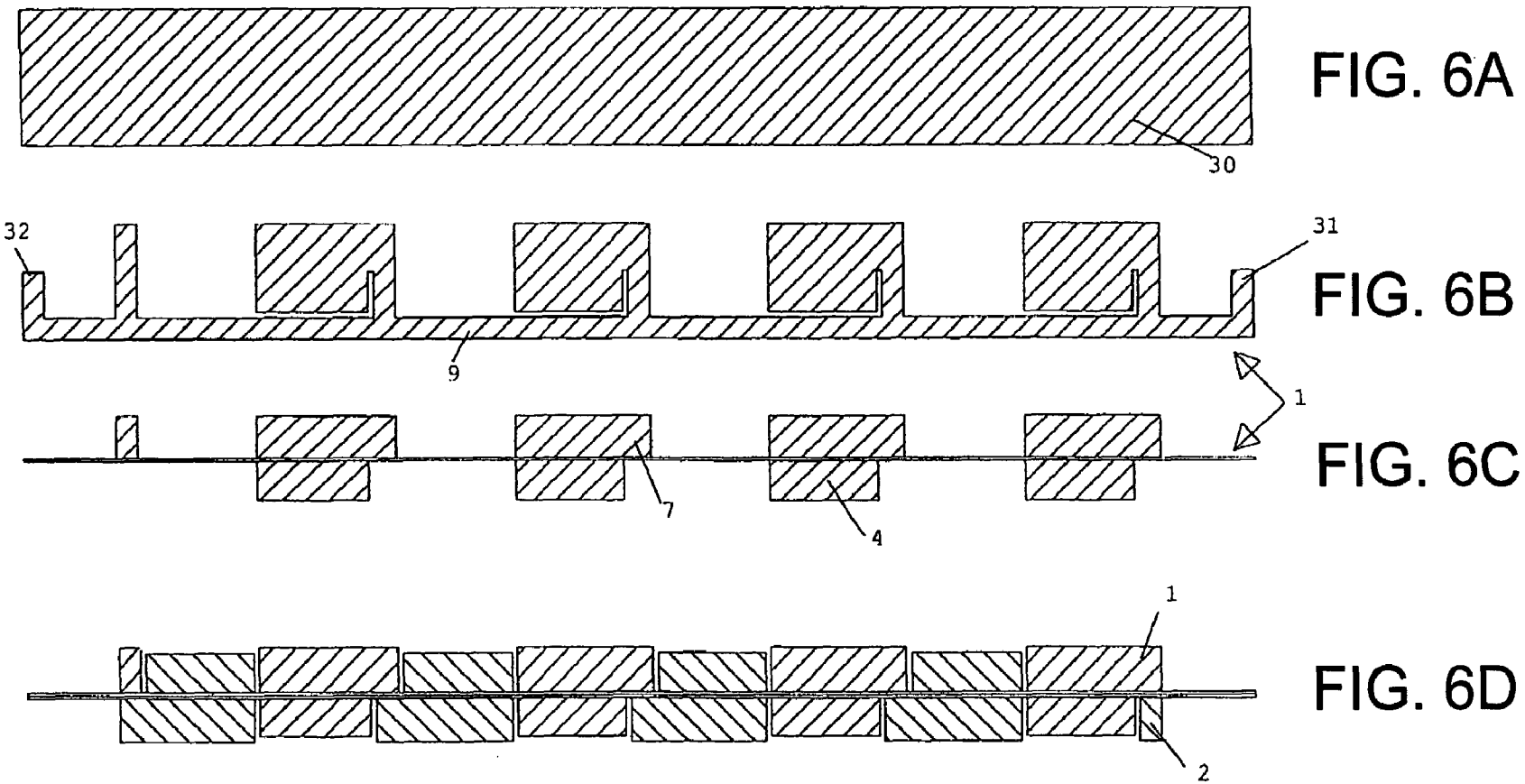
FIG. 6 shows a sheet cutting, folding and assembly pattern of a complete device according to the invention.
Figures 7A, 7B, 7C, 7D:
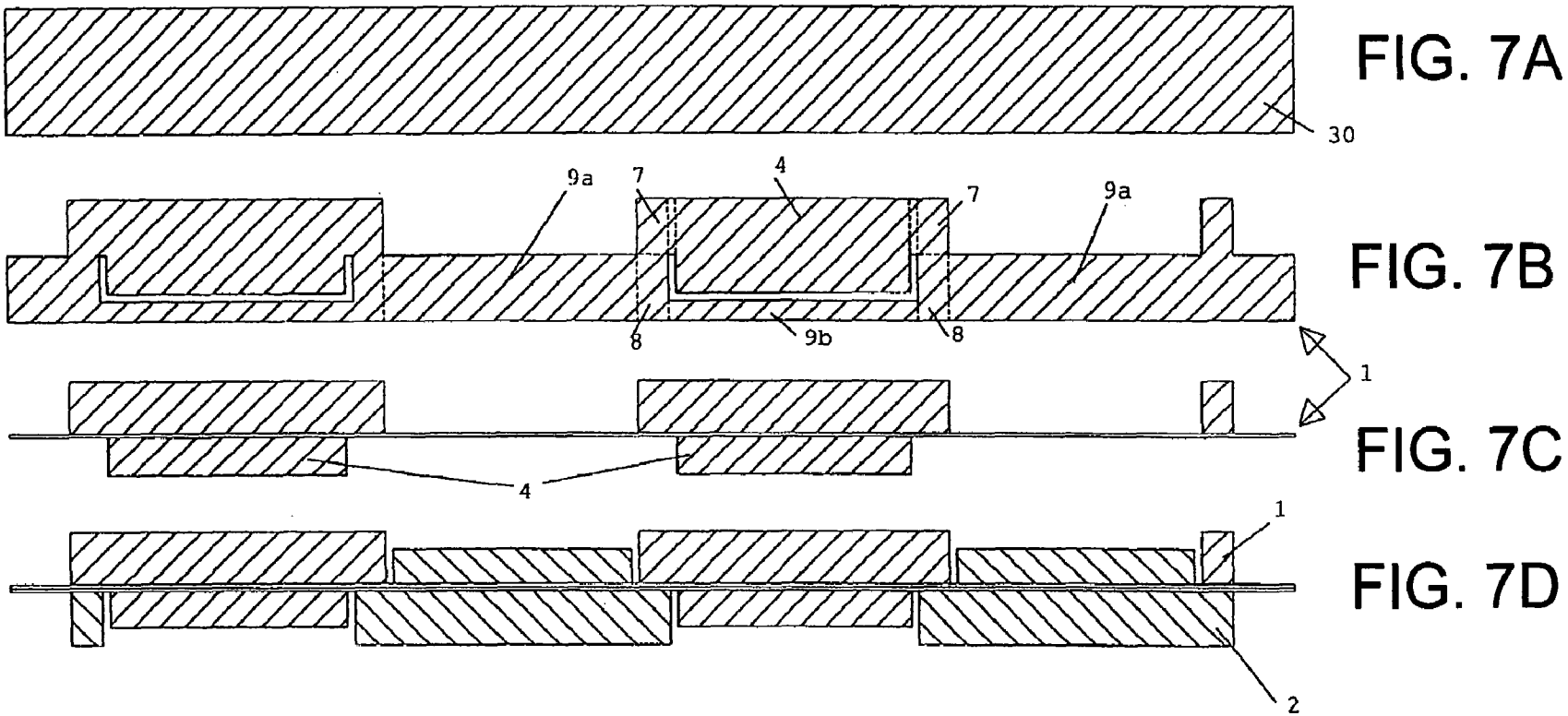
FIG. 7 shows another sheet cutting, folding and assembly pattern for achieving a particular embodiment of the invention.

The detail in FIG. 4*a* shows clearly what is referred to in the context of this description as elements 4, 6, 7, 8, 9 and 13 of the embodiment shown in FIGS. 1 to 3. FIG. 4*b* shows an embodiment which is slightly different and in which the longitudinal members 9 consist of a part 9*a*, which extends essentially over the full height of the device, and a part 9*b*, which extends over a lesser height. In the assembly, the parts 9*a* of one of the two modules will be situated opposite parts 9*b* of the other module. The parts 9*a* of the two modules will thus essentially block the passage of the concrete from one side of the joint to the other. In this embodiment of the device of the invention, it is thus possible to omit the separation sheet 12. In certain cases, it may nevertheless be useful to add a separation sheet, a sheet of polystyrene for example, which can compensate for significant expansion of the slabs.

FIGS. 5*a* to 5*d* show an embodiment which is not provided with the longitudinal members 13 in the plane of the projections 4. The principle of this embodiment is equivalent to the preceding one although it is less rigid.

FIGS. 6*a* to 6*d* show a preferred embodiment of a complete device of the invention. Each of the modules 1 or 2 is represented as having four projections 4. At their ends, the modules 1 and 2 have extensions 31 and 32 in the form of vertical parts, which make it easier to fit a second device which forms an angle with the first.

FIGS. 7*a* to 7*d* show yet another embodiment, more particularly a specific cutting, folding and assembly pattern according to the invention. The dotted lines represent the limits of the parts bearing the reference numbers indicated. In this form of the assembled device of the invention, each projection 4 of one of the two modules 1, 2 is situated between two parts 7 of the right angle of the other module. This device is equivalent to the devices already described. It includes two types of longitudinal member 9: the longitudinal members 9*a*, which extend essentially over the height of the complete device, and the longitudinal members 9*b*, which extend over a lesser height.

In the assembly, the parts 9*a* of one module will be opposite parts 9*b* of the other module. As in the embodiment shown in FIG. 4*b*, it is thus possible to omit the separation sheet 12, except in particular cases.

The invention claimed is:

1. A device to establish a connection between two adjacent slabs, said device comprising:

first and second modules derived from sheets, each of the modules comprising:

a series of flat first elements, which have projections, aligned in the same plane, a series of second elements in the form of a right angle, each of said second elements comprising a first flat part, which is in the same plane as said projections and which is integral with one of said projections, and a raised second flat part, which forms a right angle with said first part, and with said projection, flat third elements, which are in the same plane as said raised parts and which form connections in the form of first longitudinal members between said raised parts, said first module disposed adjacent to said second module with the raised parts of the first and second module facing each other along the two sides of a center plane and the longitudinal members of the first and second module equally facing each other along the two sides of said same center plane, and the projections of each module mesh together and extend on both sides of said center plane.

2. The device as claimed in claim 1, which furthermore comprises flat fourth elements which are in the same plane as said projections of the first and second modules and form connections in the form of second longitudinal members, each second longitudinal member being present between the ends of one of said projections and of one of said first parts, being situated in the same plane as said projections.

3. The device according to claim 1, which furthermore comprises a separation element, between the first and second modules.

4. The device according to claim 3 wherein said separation element is a foil.

5. The device according to claim 3 wherein said separation element is a sheet.

6. The device according to claim 1, wherein the first and second modules are fixed to one another by temporary fixing means.

7. The device according to claim 1, wherein the first and second modules are provided with anchoring elements.

* * * * *